US006666296B1

(12) United States Patent
Mathis et al.

(10) Patent No.: US 6,666,296 B1
(45) Date of Patent: Dec. 23, 2003

(54) SPEAKER ASSEMBLY

(76) Inventors: Wayman G. Mathis, 2003 Tomahawk Dr., Point Mugu, CA (US) 93042; Barbra A. Mathis, 2003 Tomahawk Dr., Point Mugu, CA (US) 93042

( * ) Notice: Subject to any disclaimer, the term of this patent is extended or adjusted under 35 U.S.C. 154(b) by 0 days.

(21) Appl. No.: 10/428,633

(22) Filed: May 5, 2003

(51) Int. Cl.[7] ..... A47B 81/06
(52) U.S. Cl. ..... 181/199
(58) Field of Search ..... 181/199, 198, 181/200, 201, 202, 205, 175, 182, 189

(56) References Cited

U.S. PATENT DOCUMENTS

D220,629 S 5/1971 Shimizu
4,173,266 A * 11/1979 Pizer et al. ..... 181/156
4,182,931 A 1/1980 Kenner
4,223,760 A 9/1980 LeTourneau
4,908,601 A 3/1990 Howze
5,374,124 A * 12/1994 Edwards ..... 381/351
6,009,972 A 1/2000 Choi et al.
6,056,083 A 5/2000 Daniell
6,243,477 B1 * 6/2001 Ruiz ..... 381/351
6,356,642 B1 3/2002 Nakamura et al.

* cited by examiner

*Primary Examiner*—Kimberly Lockett

(57) ABSTRACT

A speaker assembly includes a frame having a bottom portion, a plurality of vertical supports and a top wall. A pair of dividing walls is positioned in the frame and attached to the supports. A first wall of the pair of dividing walls is positioned generally between the top wall and the bottom portion. A second wall of the pair of dividing walls is positioned generally between the first wall and the top wall. A first compartment is defined between top wall and the first wall, a second compartment is defined between the first wall and the second wall, and a third compartment is defined between the second wall and the bottom portion. A plurality of tweeter speakers is mounted in the first compartment. A plurality of mid-range speakers is mounted in the second compartment. A base speaker is mounted in the third compartment.

10 Claims, 4 Drawing Sheets

SPEAKER ASSEMBLY

BACKGROUND OF THE INVENTION

1. Field of the Invention

The present invention relates to speaker constructions and more particularly pertains to a new speaker construction for providing stereo sound from one speaker assembly.

2. Description of the Prior Art

The use of speaker constructions is known in the prior art. While these devices fulfill their respective, particular objectives and requirements, the need remains for a device that provides 4-channel stereo sound from a single unit.

SUMMARY OF THE INVENTION

The present invention meets the needs presented above by providing a frame including a bottom portion. A plurality of vertical supports is attached to and extends upwardly from the bottom portion. A top wall is attached to an upper end of the supports. A pair of dividing walls is positioned in the frame and attached to the supports. Each of the dividing walls is orientated substantially horizontally. A first wall of the pair of dividing walls is positioned generally between the top wall and the bottom portion. A second wall of the pair of dividing walls is positioned generally between the first wall and the top wall. A first compartment is defined between top wall and the first wall, a second compartment is defined between the first wall and the second wall, and a third compartment is defined between the second wall and the bottom portion. A plurality of tweeter speakers is mounted in the first compartment. A plurality of mid-range speakers is mounted in the second compartment. A base speaker is mounted in the third compartment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
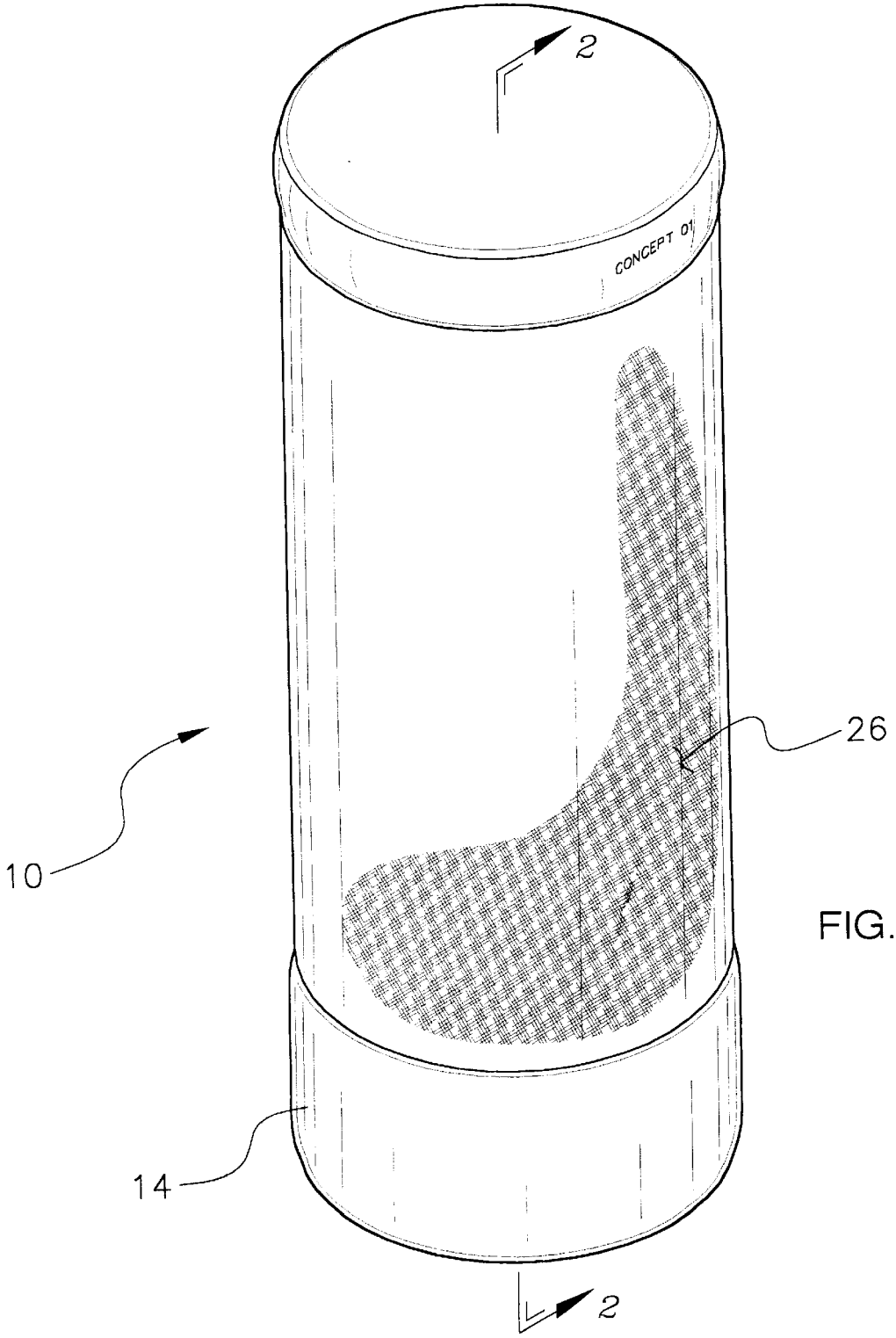
FIG. 1 is a schematic speaker view of a speaker assembly according to the present invention.
Figure 2:
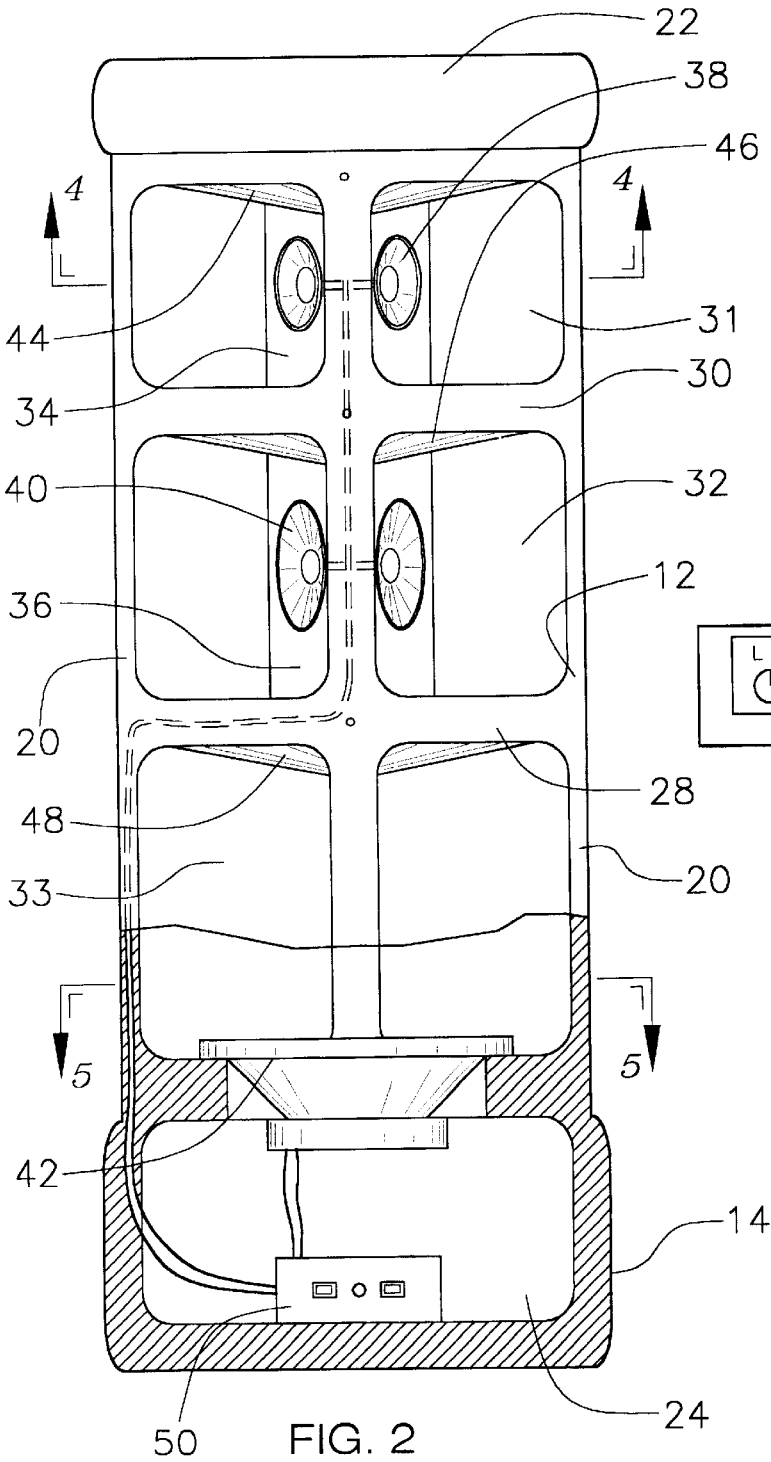
FIG. 2 is a schematic broken-side view of the present invention.
Figure 3:
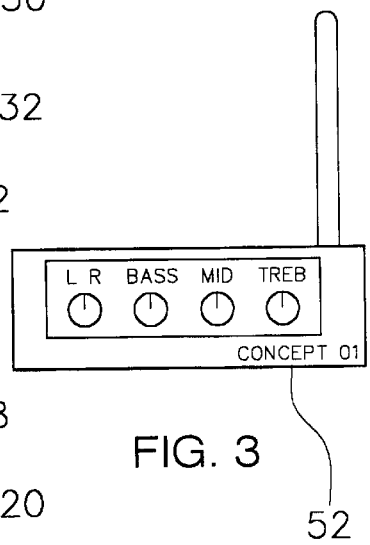
FIG. 3 is a schematic front view of the transmitter of the present invention.
Figure 4:
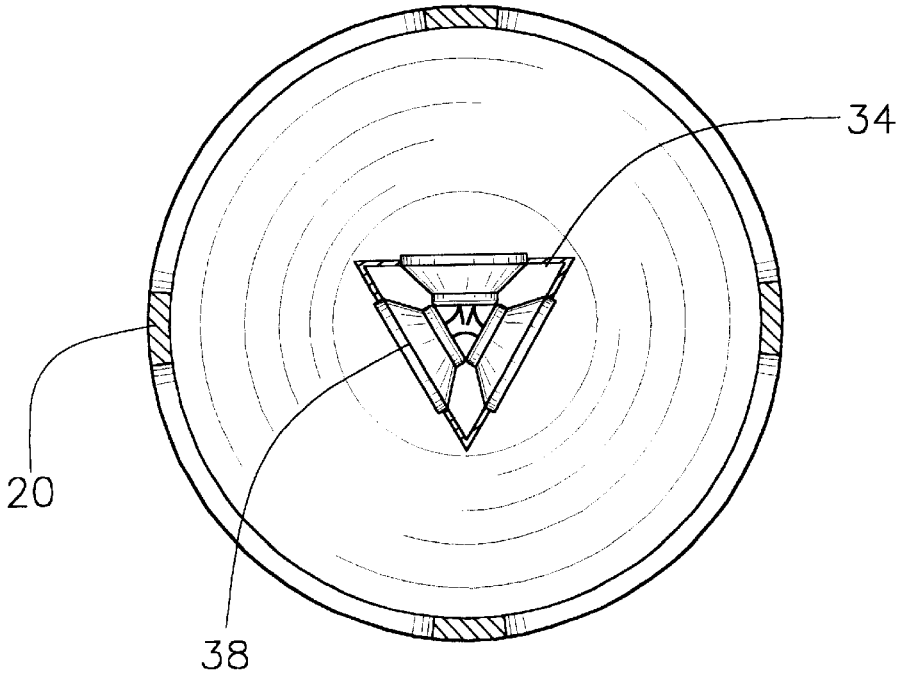
FIG. 4 is a schematic cross-sectional view taken along line 4—4 of FIG. 2 of the present invention.
Figure 5:
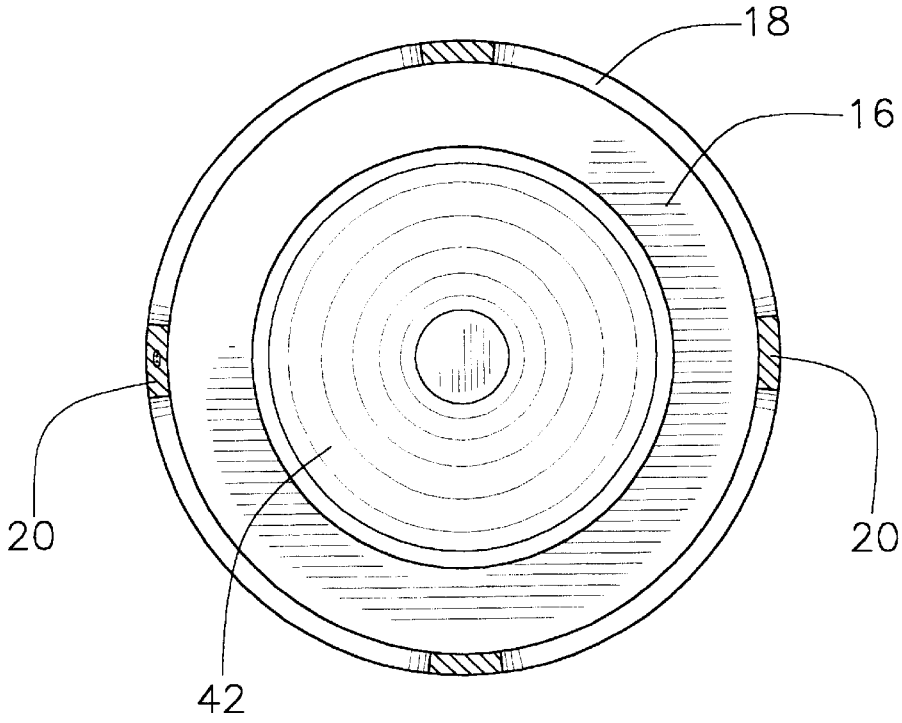
FIG. 5 is a schematic cross-sectional view taken along line 5—5 of FIG. 2 of the present invention.
Figure 6:
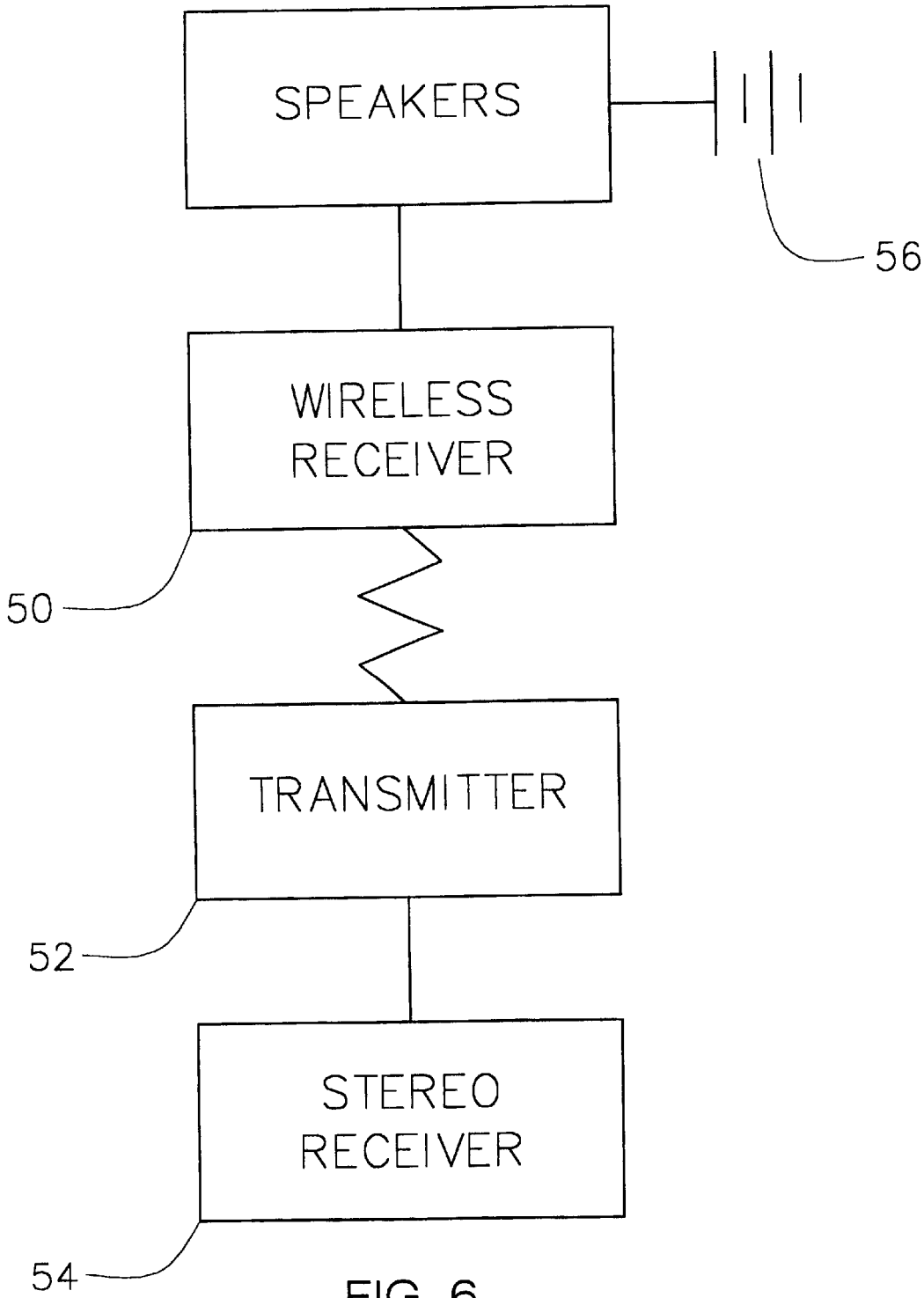
FIG. 6 is an electronic schematic view of the present invention.

With reference now to the drawings, and in particular to FIGS. 1 through 6 thereof, a new speaker construction embodying the principles and concepts of the present invention and generally designated by the reference numeral 10 will be described.

As best illustrated in FIGS. 1 through 6, the speaker assembly 10 generally comprises a frame 12 including a bottom portion 14. The bottom portion 14 has an upper surface 16 having a peripheral edge 18. A plurality of vertical supports 20 is attached to and extends upwardly from the bottom portion 14. The vertical supports 20 are spaced from each other. The vertical supports 20 are positioned adjacent to the peripheral edge 18 of the bottom portion 14. A top wall 22 is attached to an upper end of the vertical supports 20. The bottom portion 14 has a cavity 24 positioned therein. A covering 26 is positioned on the vertical supports 20 and extends between the bottom portion 14 and the top wall 22. The covering 26 is air permeable. The covering 26 comprises a cloth material. The peripheral edge 1 8 has a generally circular shape.

A pair of dividing walls is positioned in the frame 12 and attached to the supports 20. Each of the dividing walls is orientated substantially horizontally. A first wall 28 of the pair of dividing walls is positioned generally between the top wall 22 and the bottom portion 14. A second wall 30 of the pair of dividing walls is positioned generally between the first wall 28 and the top wall 22. A first compartment 31 is defined between top wall 22 and the second wall 30, a second compartment 32 is defined between the first wall 28 and the second wall 30, and a third 33 compartment is defined between the first wall 28 and the bottom portion 14.

A first mounting 34 is attached to and extending upwardly from the second wall 30, and a second mounting 36 is attached to and extending upwardly from the first wall 28. The first 34 and second 36 mountings are centrally disposed on a respective one of the first 28 and second 30 walls.

Three tweeter speakers 38 are mounted on the first mounting 34. The tweeter speakers 38 are spaced from each other around the first mounting such each of the tweeter speakers 38 are directed outwardly. The tweeter speakers 38 each lie in a same plane. There is 120 degrees of directional separation between adjacent pairs of the tweeter speakers 38. Tweeter speakers, as the term is known in the art, include small loudspeakers that are designed to reproduce high-pitched sounds in a high-fidelity audio system. The tweeter speakers 38 of the current device are preferably those having a 3" surface diameter.

Three mid-range speakers 40 are mounted on the second mounting 36. The mid-range speakers 40 are spaced from each other around the second mounting such each of the mid-range speakers are directed outwardly. The mid-range speakers 40 each lie in a same plane. There is 120 degrees of directional separation between adjacent pairs of the mid-range speakers. Ideally, each of the mid-range speakers 40 is vertically aligned with one of the tweeter speakers 38. The mid-range speakers 40 of the current device are preferably those having a 4" surface diameter.

A base speaker 42 is mounted in the upper surface 16 of the bottom portion 14 and extends into the cavity 24. The base speaker 42 is directed upwardly. The base speaker 42 of the current device preferably has a 12" surface diameter.

A plurality of sound reflecting discs is mounted in the frame 12. A first 44 of the discs is mounted on top wall 22 and is directed downward toward the tweeter speakers 38. A second 46 of the discs is mounted on the second wall 30 and is directed downward toward the mid-range speakers 40. A third 48 of the discs is mounted on the first wall 28 and is directed downward toward the base speaker 42. Preferably, each of the discs has a downward directed convex surface. The discs 44, 46, 48 are preferably constructed of rigid material having a relatively high density such as a metal or porcelain.

The speaker assembly 10 preferably includes a wireless receiver 50 adapted for varying the relative outputs of the speakers in the speaker assembly 10 and for sending audio output signals to the speakers. The wireless receiver 50 would be electrically coupled to each of the speakers in the speaker assembly 10. A transmitting unit 52 would be used to send the audio output signals to the wireless receiver 50. The transmitting unit 52 may be operationally coupled to a conventional receiver 54 for transmitting audio output signals to the speakers. In this manner, the speaker assembly 10 would be operational as long as they are within the range of the transmitting unit. The speaker assembly 10 would preferably include a conventional power supply 54 electrically coupled to each of the speakers. The power supply 56 may include a cord that would be plugged into a conventional electrical outlet.

In use, the speaker assembly would be used as a conventional speaker only it would include all of the speakers required to form 3-dimensional stereo sound because of the direction of the speakers. The speaker assembly would have the functional equivalent of a conventional 4-channel speaker system.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A speaker assembly comprising:

a frame including a bottom portion, a plurality of vertical supports being attached to and extending upwardly from said bottom portion, a top wall being attached to an upper end of said vertical supports;

a pair of dividing walls being positioned in said frame and attached to said vertical supports, each of said dividing walls being orientated substantially horizontally, a first wall of said pair of dividing walls being positioned generally between said top wall and said bottom portion, a second wall of said pair of dividing walls being positioned generally between said first wall and said top wall, wherein a first compartment is defined between said top wall and said second wall, a second compartment is defined between said first wall and said second wall, and a third compartment is defined between said first wall and said bottom portion;

a plurality of tweeter speakers being mounted in said first compartment;

a plurality of mid-range speakers being mounted in said second compartment; and a base speaker being mounted in said third compartment.

2. The speaker assembly of claim 1, wherein said bottom portion has an upper surface having a peripheral edge, said peripheral edge having a circular shape, each of said tweeter speakers being spaced from each other and being directed outwardly, each of said tweeter speakers lying in a same plane, each of said mid-range speakers being spaced from each other and being directed outwardly, each of said mid-range speakers lying in a same plane.

3. The speaker assembly of claim 2, further including a covering being positioned on said vertical supports and extending between said bottom portion and said top wall, said covering comprising a cloth material.

4. The speaker assembly of claim 2, wherein there is 120 degrees of directional separation between adjacent pairs of said tweeter speakers, and wherein there is 120 degrees of directional separation between adjacent pairs of said mid-range speakers.

5. The speaker assembly of claim 4, wherein each of said mid-range speakers is vertically aligned with one of said tweeter speakers.

6. The speaker assembly of claim 1, wherein each of said mid-range speakers is vertically aligned with one of said tweeter speakers.

7. The speaker assembly of claim 4, wherein said base speaker is mounted in said upper surface of said bottom portion and extending into a cavity in said bottom portion, said base speaker being directed upwardly.

8. The speaker assembly of claim 1, further including a plurality of sound reflecting discs being mounted in said frame, a first of said discs being mounted on top wall and being directed downward toward said tweeter speakers, a second of said discs being mounted on said second wall and being directed downward toward said mid-range speakers, a third of said discs being mounted on said first wall and being directed downward toward said base speaker.

9. The speaker assembly of claim 4, further including a plurality of sound reflecting discs being mounted in said frame, a first of said discs being mounted on top wall and being directed downward toward said tweeter speakers, a second of said discs being mounted on said second wall and being directed downward toward said mid-range speakers, a third of said discs being mounted on said first wall and being directed downward toward said base speaker.

10. A speaker assembly comprising:

a frame including a bottom portion, said bottom portion having an upper surface having a peripheral edge, a plurality of vertical supports being attached to and extending upwardly from said bottom portion, said vertical supports being spaced from each other, said vertical supports being positioned adjacent to said peripheral edge of said bottom portion, a top wall being attached to an upper end of said vertical supports, said bottom portion having a cavity positioned therein, a covering being positioned on said vertical supports and extending between said bottom portion and said top wall, said covering being air permeable, said covering comprising a cloth material, said peripheral edge having a generally circular shape;

a pair of dividing walls being positioned in said frame and attached to said vertical supports, each of said dividing walls being orientated substantially horizontally, a first wall of said pair of dividing walls being positioned generally between said top wall and said bottom portion, a second wall of said pair of dividing walls being positioned generally between said first wall and said top wall;

a first mounting being attached to and extending upwardly from said second wall, a second mounting being attached to and extending upwardly from said first wall, said first and second mountings being centrally disposed on a respective one of said first and second walls;

three tweeter speakers being mounted on said first mounting, said tweeter speakers being spaced from each other around said first mounting such each of said tweeter speakers are directed outwardly, said tweeter speakers each lying in a same plane, wherein there is 120 degrees of directional separation between adjacent pairs of said tweeter speakers;

three mid-range speakers being mounted on said second mounting, said mid-range speakers being spaced from each other around said second mounting such each of said mid-range speakers are directed outwardly, said mid-range speakers each lying in a same plane, wherein there is 120 degrees of directional separation between adjacent pairs of said mid-range speakers, each of said mid-range speakers being vertically aligned with one of said tweeter speakers;

a base speaker being mounted in said upper surface of said bottom portion and extending into said cavity, said base speaker being directed upwardly; and a plurality of sound reflecting discs being mounted in said frame, a first of said discs being mounted on top wall and being directed downward toward said tweeter speakers, a second of said discs being mounted on said second wall and being directed downward toward said mid-range speakers, a third of said discs being mounted on said first wall and being directed downward toward said base speaker, each of said discs having a downward directed convex surface.

* * * * *